US012446698B2

(12) United States Patent
Nakagawa

(10) Patent No.: US 12,446,698 B2
(45) Date of Patent: Oct. 21, 2025

(54) OPTIONAL ACCESSORY-ATTACHING MEMBER

(71) Applicant: AICHI CO., LTD., Nagoya (JP)

(72) Inventor: Hokuto Nakagawa, Kasugai (JP)

(73) Assignee: AICHI CO., LTD., Nagoya (JP)

( * ) Notice: Subject to any disclaimer, the term of this patent is extended or adjusted under 35 U.S.C. 154(b) by 238 days.

(21) Appl. No.: 18/480,684

(22) Filed: Oct. 4, 2023

(65) Prior Publication Data

US 2024/0130534 A1 Apr. 25, 2024
US 2024/0225295 A9 Jul. 11, 2024

(30) Foreign Application Priority Data

Oct. 24, 2022 (JP) ..... 2022-169792

(51) Int. Cl.
*A47K 1/08* (2006.01)
*A47C 7/62* (2006.01)
*A47C 7/70* (2006.01)

(52) U.S. Cl.
CPC ..... *A47C 7/622* (2018.08)

(58) Field of Classification Search
CPC .... A47C 4/10; A47C 4/20; A47C 7/70; A47C 7/622; A47C 7/624; A47C 31/11
USPC ..... 297/188.2
See application file for complete search history.

(56) References Cited

U.S. PATENT DOCUMENTS 4,997,156 A * 3/1991 Allen ..... A47C 7/624 248/314
D373,935 S * 9/1996 Cole ..... D7/620
5,628,485 A * 5/1997 Ray ..... A47G 23/0225 248/231.61
2018/0338622 A1* 11/2018 Doolan ..... A47C 4/10
2018/0338623 A1* 11/2018 Winterhalter ..... A47C 4/10
2024/0130534 A1* 4/2024 Nakagawa ..... A47C 7/622
2024/0225295 A9* 7/2024 Nakagawa ..... A47C 7/622
2025/0151909 A1* 5/2025 Kono ..... A47C 31/11

FOREIGN PATENT DOCUMENTS

JP 3008964 U 3/1995
JP 3023308 U 4/1996
JP H10234513 A 9/1998
JP 2010268997 A 12/2010
JP 2022028519 A 2/2022

* cited by examiner

*Primary Examiner* — Shin H Kim

(74) *Attorney, Agent, or Firm* — Withrow + Terranova, PLLC; Vincent K. Gustafson

(57) ABSTRACT

A holding part is configured to hold a pillar member and includes first and second holding parts each including a part configured to face an outer circumferential surface of the pillar member from a first side at a position different from and spaced from each other. A lock part is configured to be displaced between lock and unlock positions. The lock position brings the lock part into contact with the outer circumferential surface of the pillar member from a second side at a position between the first and second holding parts. The unlock position releases a contact of the lock part with the outer circumferential surface of the pillar member. When the lock part is at the lock position, the first and second holding parts as well as the lock part hold the pillar member, to thereby lock a position of the holding part with respect to the pillar member.

6 Claims, 6 Drawing Sheets

OPTIONAL ACCESSORY-ATTACHING MEMBER

CROSS-REFERENCE TO RELATED APPLICATIONS

This application claims the benefit of Japanese Patent Application No. 2022-169792 filed on Oct. 24, 2022 with the Japan Patent Office, the entire disclosure of which is incorporated herein by reference.

BACKGROUND

The present disclosure relates to an optional accessory-attaching member.

Japanese Unexamined Patent Application Publication No. 2010-268997 discloses an optional accessory-attaching member of a detachable type that can attach an optional accessory such as a writing table and an arm rest to a chair. The optional accessory-attaching member is formed by fixing, to an optional accessory-holding pipe extending in a left-right direction, a right leg metal attachment for holding a right leg extending in an up-down direction; a left leg metal attachment for holding a left leg extending in the up-down direction; and a metal hook for holding a coupling rod coupling the left and right legs. The right leg metal attachment, the left leg metal attachment, and the metal hook attach the optional accessory-attaching member to the right leg, the left leg, and the coupling rod, whereby the optional accessory is fixed to the chair.

SUMMARY

However, a problem has been found that since there is a need for holding a number of parts of the chair including the right leg, the left leg, and the coupling rod so as to attach the optional accessory to the chair, the optional accessory-attaching member described above requires a number of components and thus makes its configuration complicated.

In one aspect of the present disclosure, it is preferable to provide an optional accessory-attaching member detachable to a pillar member of a piece of furniture with a simple configuration.

One aspect of the present disclosure provides an optional accessory-attaching member to be used in a piece of furniture including a pillar member. The optional accessory-holding member comprises a holding part, a lock part, and an optional accessory-holding part. The holding part is configured to hold the pillar member. The lock part is configured to be able to lock a position of the holding part with respect to the pillar member. The optional accessory-holding part is configured to hold an optional accessory. The holding part includes a first holding part and a second holding part. The first holding part includes a part configured to face an outer circumferential surface of the pillar member from a first side with respect to the pillar member. The second holding part includes a part configured to face the outer circumferential surface of the pillar member from the first side at a position different from and spaced apart from the first holding part. The lock part is configured to be displaced between a lock position and an unlock position. The lock position brings the lock part into contact with the outer circumferential surface of the pillar member from a second side substantially opposite to the first side with respect to the pillar member at a position between the first holding part and the second holding part. The unlock position releases a contact of the lock part with the outer circumferential surface of the pillar member. When the lock part is at the lock position, the first holding part and the second holding part as well as the lock part hold the pillar member, to thereby lock a position of the holding part with respect to the pillar member.

In the above-described configuration, the pillar member is held by the first holding part, the second holding part, and the lock part when the lock part is displaced from the unlock position to the lock position. Consequently, the optional accessory-attaching member can be attached to the piece of furniture including the pillar member in a state where the position of the holding part is locked with respect to the pillar member. Here, locking includes immovably fixing the holding part with respect to the pillar member and loosely holding the pillar member with the holding part. Moreover, the pillar member is released from being held by the lock part, the first holding part, and the second holding part when the lock part is displaced from the lock position to the unlock position. Consequently, the holding part can be removed from the pillar member. Therefore, the optional accessory-attaching member can be attached to and detached from the pillar member with a simple configuration of displacing the position of the lock part.

In one aspect of the present disclosure, the pillar member may include a vertical pillar and a horizontal stretcher. The vertical pillar extends in a substantially up-down direction. The horizontal stretcher extends from the vertical pillar in a direction intersecting the substantially up-down direction. The holding part may be configured to hold the vertical pillar and the horizontal stretcher. The first holding part may face an outer circumferential surface of the vertical pillar from the first side. The second holding part may include a part configured to face an outer circumferential surface of the horizontal stretcher from the first side and from an upper side. When the lock part is at the lock position, the lock part may contact the outer circumferential surface of the vertical pillar from the second side. In such a configuration, since the second holding part faces the horizontal stretcher from the first side and from the upper side when the holding part holds the horizontal stretcher, a downward positional displacement of the holding part can be suppressed.

In one aspect of the present disclosure, the pillar member may include a vertical pillar and a horizontal stretcher. The vertical pillar extends in a substantially up-down direction. The horizontal stretcher extends from the vertical pillar in a direction intersecting the substantially up-down direction. The holding part may be configured to hold the vertical pillar and the horizontal stretcher. The first holding part may face an outer circumferential surface of the vertical pillar from the first side. The second holding part may include a part configured to face an outer circumferential surface of the horizontal stretcher from the first side and from an upper side. When the lock part is at the lock position, the lock part may contact the outer circumferential surface of the horizontal stretcher from the second side. In such a configuration, since the second holding part faces the horizontal stretcher from the first side and from the upper side when the holding part holds the horizontal stretcher, the downward positional displacement of the holding part can be suppressed.

In one aspect of the present disclosure, the pillar member may include a vertical pillar extending at least in a substantially up-down direction. The holding part may be configured to hold the vertical pillar. The first holding part and the second holding part may face the outer circumferential surface of the vertical pillar from the first side. When the lock part is at the lock position, the lock part may contact the outer circumferential surface of the vertical pillar from the second side. In such a configuration, when the piece of furniture comprises only the vertical pillar, the holding part can be attached to the vertical pillar with a simple configuration.

In one aspect of the present disclosure, the holding part may include a coupling part coupling the first holding part and the second holding part. The lock part may be fixed to the coupling part, include a rotation axis extending from the first side toward the second side, and rotatably displaced about the rotation axis between the lock position and the unlock position. In such a configuration, the position of the holding part is locked or released from being locked with respect to the pillar member with a simple method of rotatably displacing, about the rotation axis, the lock part fixed to the coupling part.

In one aspect of the present disclosure, each holding part of the first holding part and the second holding part may include a first wall part and two wall parts. The first wall part is configured to face the outer circumferential surface of the pillar member from the first side. The two wall parts are coupled to the first wall part, and configured to face the outer circumferential surface of the pillar member at respective two other positions different from a position of the first wall part. In such a configuration, since the outer circumferential surface of the pillar member can be surrounded by the first wall part and the two other wall parts at three positions, the pillar member can be stably held by the holding part.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

1. Configuration

[1-1. Overall Configuration]

Figure 1:
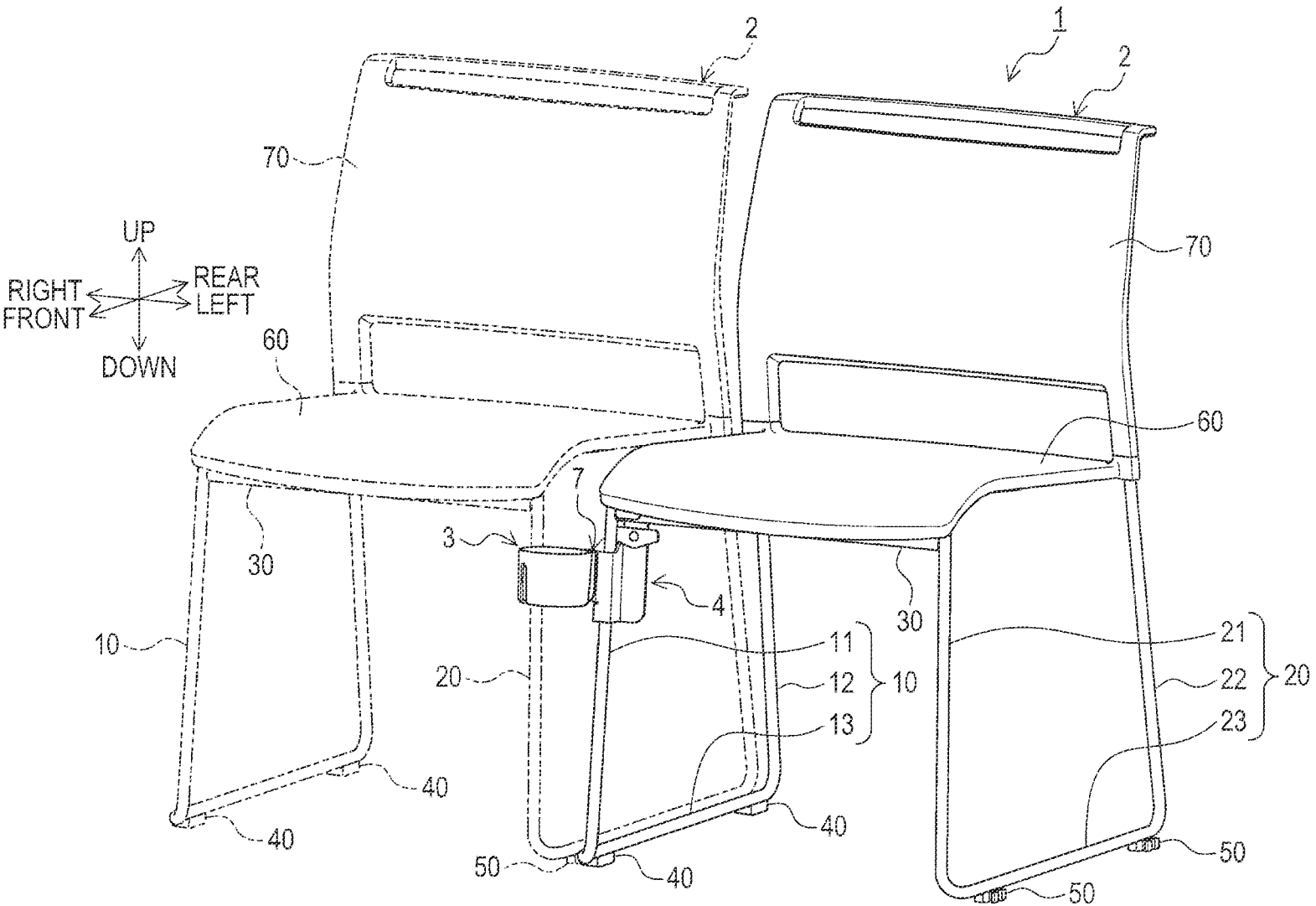
FIG. 1 is a perspective view illustrating a state where an optional accessory-attaching member is attached to a chair.
Figure 2:
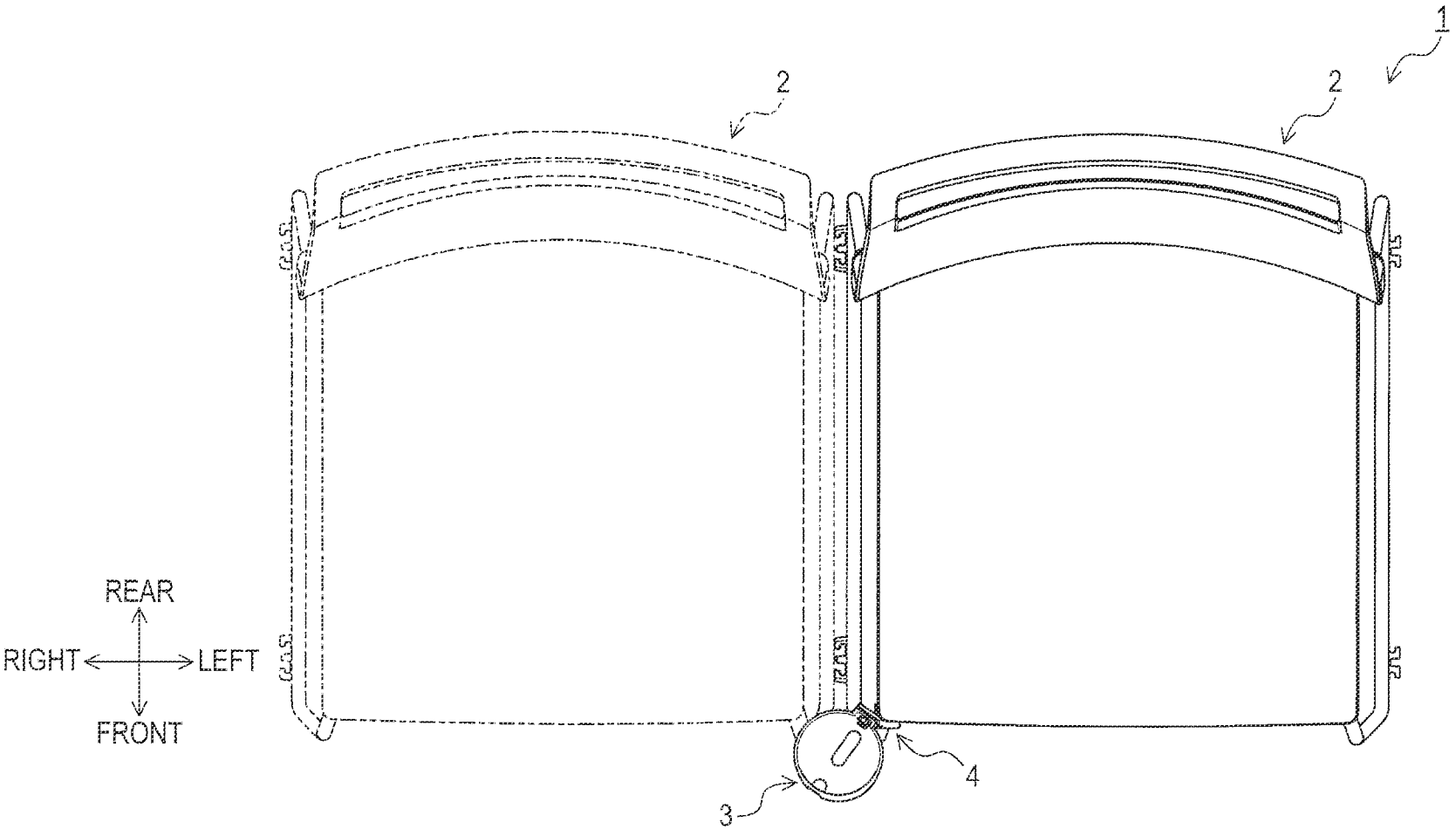
FIG. 2 is a plan view illustrating the state where the optional accessory-attaching member is attached to the chair.
Figure 3:
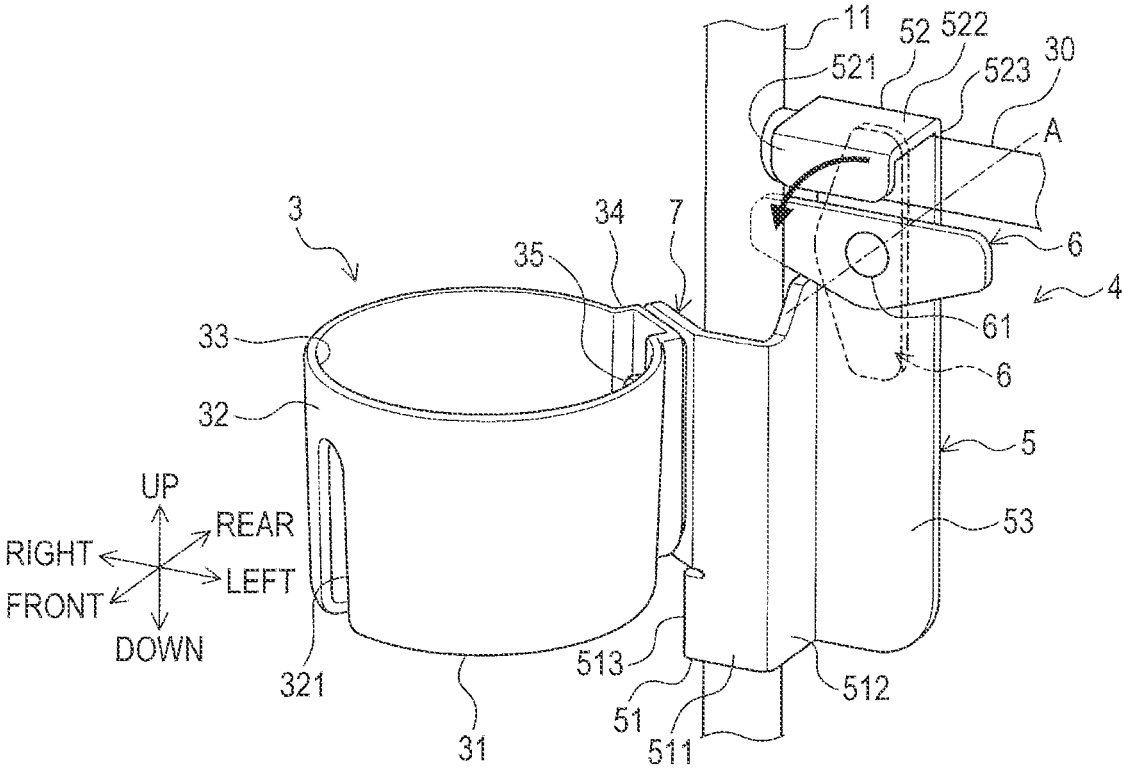
FIG. 3 is an enlarged perspective view of the optional accessory-attaching member attached to the chair, as viewed from a front side.
Figure 4:
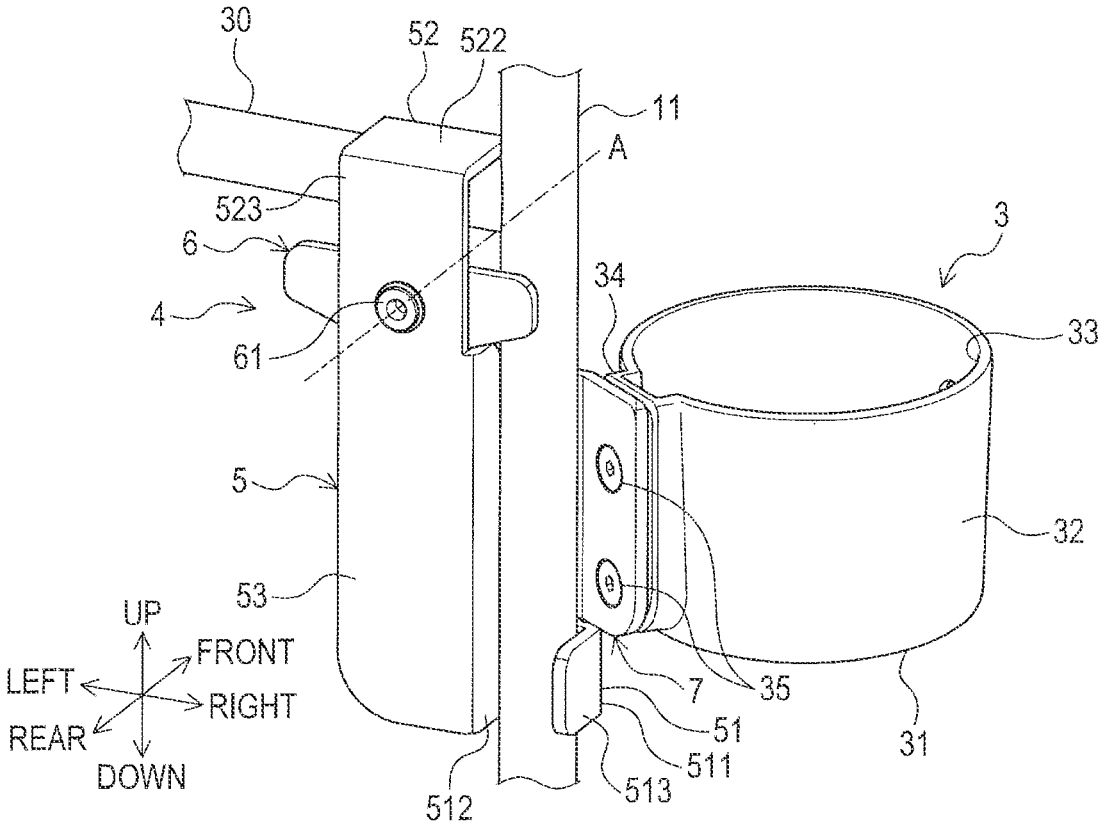
FIG. 4 is an enlarged perspective view of the optional accessory-attaching member attached to the chair, as viewed from a rear side.
Figures 5A, 5B, 5C, 5D, 5E, 5F:
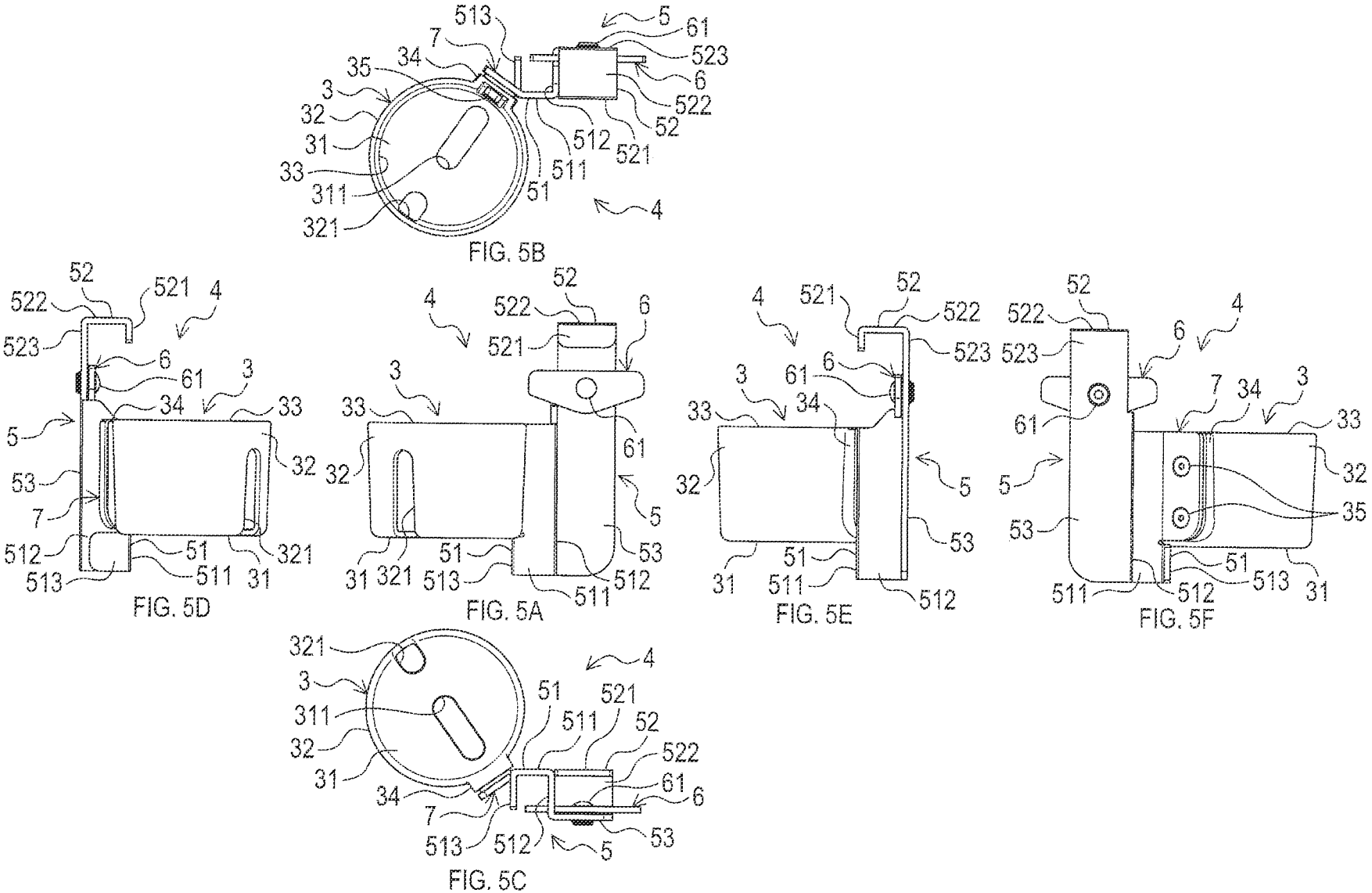
FIG. 5A is one of six views of the optional accessory-attaching member, specifically a front view of the optional accessory-attaching member.
FIG. 5B is one of the six views, specifically a plan view of the optional accessory-attaching member.
FIG. 5C is one of the six views, specifically a bottom view of the optional accessory-attaching member.
FIG. 5D is one of the six views, specifically a right-side view of the optional accessory-attaching member.
FIG. 5E is one of the six views, specifically a left-side view of the optional accessory-attaching member.
FIG. 5F is one of the six views, specifically a rear view of the optional accessory-attaching member.

FIGS. 1 and 2 show a chair set 1, which comprises a chair 2 and an optional accessory-attaching member 4 comprising a cup holder 3 as an optional accessory.

The optional accessory-attaching member 4 is configured to be able to attach the cup holder 3 to the chair 2 via an optional accessory-holding part 7 to be described later. In the following description, an up-down direction, a front-rear direction, and a left-right direction are expressed with respect to a user(s) normally seated in the chairs 2.

[1-2. Chair]

As shown in FIG. 1, the chair 2 comprises a right leg 10, a left leg 20, a coupling rod 30, two first leg ends 40, two second leg ends 50, a seat body 60, and a backrest 70.

The right leg 10 and the left leg 20 are formed by bending and welding tubular metal pipes, and are a support body supporting the seat body 60 and the backrest 70.

The right leg 10 is arranged on a right side of and below the seat body 60. The right leg 10 includes a front right pillar 11, a rear right pillar 12, and a lower right stretcher 13. The front right pillar 11 is located in a front part of the right leg 10 and extends in the up-down direction. The rear right pillar 12 is located in a rear part of the right leg 10 and extends in the up-down direction. The lower right stretcher 13 is located in a lower part of the right leg 10. The lower right stretcher 13 couples a lower end of the front right pillar 11 to a lower end of the rear right pillar 12, and is arranged along a floor surface on which the chair 2 is placed.

The left leg 20 is arranged on a left side of and below the seat body 60. The left leg 20 includes a front left pillar 21, a rear left pillar 22, and a lower left stretcher 23. The front left pillar 21 is located in a front part of the left leg 20 and extends in the up-down direction. The rear left pillar 22 is located in a rear part of the left leg 20 and extends in the up-down direction. The lower left stretcher 23 is located in a lower part of the left leg 20. The lower left stretcher 23 couples a lower end of the front left pillar 21 to a lower end of the rear left pillar 22, and is arranged along the floor surface on which the chair 2 is placed.

The coupling rod 30 is a tubular metal pipe extending from the front right pillar 11 or the front left pillar 21 of the chair 2 in a direction intersecting the up-down direction, and couples the front right pillar 11 and the front left pillar 21. In one example, the coupling rod 30 extends from the front right pillar 11 or the front left pillar 21 in the left-right direction.

The first leg ends 40 are leg ends attached to the right leg 10 of the chair 2. The second leg ends 50 are leg ends attached to the left leg 20 of the chair 2. The two first leg ends 40 are fixed with fastening members such as screws to respective front and rear parts of a surface of the lower right stretcher 13 facing the floor surface. The two second leg ends 50 are fixed with the fastening members such as screws to respective front and rear parts of a surface of the lower left stretcher 23 facing the floor surface. The first leg ends 40 and the second leg ends 50 include respective mechanisms that can couple the two chairs 2 to each other. Thus, the two chairs 2 can be coupled via the first leg ends 40 of one chair of the two chairs 2 and the second leg ends 50 of the other chair of the two chairs 2.

The seat body 60 is formed in a substantially rectangular shape, and configured to allow the user to be seated.

The backrest 70 is formed in a substantially rectangular shape, and configured to be able to support the back of the user to be seated.

[1-3. Optional Accessory-Attaching Member]

As illustrated in FIGS. 3, 4, and 5A through 5F, the optional accessory-attaching member 4 comprises a holding part 5, a lock part 6, the optional accessory-holding part 7, and the cup holder 3.

<Holding Part>

In the present embodiment, the holding part 5 holds the front right pillar 11 and the coupling rod 30 of the chair 2. The holding part 5 includes a first holding part 51, a second holding part 52, and a coupling part 53.

The first holding part 51 can hold the front right pillar 11. The first holding part 51 is formed in a plate-shape extending in the up-down direction, and includes a part having a substantially U-shaped configuration in a cross section orthogonal to the up-down direction. In other words, the first holding part 51 has a shape covering a part of an outer circumferential surface of the front right pillar 11 and opening rearward (i.e., including an opening) so as to allow the front right pillar 11 to run therethrough. In the present embodiment, the first holding part 51 faces the outer circumferential surface of the front right pillar 11 from front, left, and right sides, and holds the front right pillar 11. Specifically, the first holding part 51 includes a first wall part 511, a second wall part 512, and a third wall part 513.

The first wall part 511 faces the outer circumferential surface of the front right pillar 11 from the front side. The second wall part 512 and the third wall part 513 are coupled to the first wall part 511, and face the outer circumferential surface of the front right pillar 11 at respective other two positions different from that of the first wall part 511. Specifically, the second wall part 512 extends substantially perpendicularly from a left end of the first wall part 511 toward a rear side and faces the outer circumferential surface of the front right pillar 11 from the left side. The third wall part 513 extends substantially perpendicularly from a right end of the first wall part 511 toward the rear side and faces the outer circumferential surface of the front right pillar 11 from the right side. In the present embodiment, the third wall part 513 is provided to only a partial area of the first wall part 511 in the up-down direction, for example, a lower area of the first wall part 511. It should be noted that the third wall part may be provided to an entire area of the first wall part 511 in the up-down direction. Alternatively, the third wall part may be provided to two or more different areas of the first wall part 511 in the up-down direction at intervals.

In the first holding part 51, an interval between an inner surface of the second wall part 512 and an inner surface of the third wall part 513 facing in the left-right direction is substantially the same length as, or larger than an outer diameter of the front right pillar 11. In other words, the first holding part 51 is formed such that the front right pillar 11 is closely fitted to an inside of the first holding part 51 or the front right pillar 11 is loosely inserted into the first holding part 51.

The second holding part 52 can hold the coupling rod 30 at a position different from and spaced apart from the first holding part 51. In the present embodiment, the second holding part 52 is located upward and leftward of the first holding part 51. The second holding part 52 is formed in a plate-shape extending in the left-right direction, and has a substantially U-shaped configuration in a cross section orthogonal to the left-right direction. In other words, the second holding part 52 has a shape covering a part of an outer circumferential surface of the coupling rod 30 and opening downward (i.e., including an opening) so as to allow the coupling rod 30 to run therethrough. In the present embodiment, the second holding part 52 faces the outer circumferential surface of the coupling rod 30 from the front, upper, and rear sides and holds the coupling rod 30. In other words, the second holding part 52 is hooked on the coupling rod 30. Specifically, the second holding part 52 includes a first wall part 521, a second wall part 522, and a third wall part 523.

The first wall part 521 faces the outer circumferential surface of the coupling rod 30 from the front side. The second wall part 522 and the third wall part 523 are coupled to the first wall part 521, and face the outer circumferential surface of the coupling rod 30 at respective other two positions different from that of the first wall part 521. Specifically, the second wall part 522 extends substantially perpendicularly from an upper end of the first wall part 521 toward the rear side, and faces the outer circumferential surface of the coupling rod 30 from the upper side. The third wall part 523 extends substantially perpendicularly from a rear end of the second wall part 522 toward a lower side and faces the outer circumferential surface of the coupling rod 30 from the rear side.

In the second holding part 52, an interval between an inner surface of the first wall part 521 and an inner surface of the third wall part 523 facing in the front-rear direction is larger than a summed length of the outer diameter of the coupling rod 30 and a thickness of the lock part 6 to be described later. In other words, the coupling rod 30 is loosely inserted into the second holding part 52.

The coupling part 53 couples the first holding part 51 and the second holding part 52. In the present embodiment, the coupling part 53 couples a rear end of the second wall part 512 of the first holding part 51 to a lower end of the third wall part 523 of the second holding part 52. The coupling part 53 is arranged substantially perpendicularly with respect to the second wall part 512 of the first holding part 51, and is formed in a plate-shape extending in the up-down direction on the same plane as the third wall part 523 of the second holding part 52.

An interval between an inner surface of the first wall part 511 of the first holding part 51 and a front surface of the coupling part 53 is substantially the same length as the summed length of the outer diameter of the front right pillar 11 and the thickness of the lock part 6 to be described later. It should be noted that the interval between the inner surface of the first wall part of the first holding part and the front surface of the coupling part may be larger than the summed length of the outer diameter of the front right pillar 11 and the thickness of the lock part.

<Lock Part>

The lock part 6 is configured to be able to lock a position of the holding part 5 with respect to the front right pillar 11 and the coupling rod 30. In the present embodiment, the lock part 6 is formed in a substantially rectangular plate-shape, and is fixed with a shaft pin 61 so as to overlap with the front surface of the coupling part 53 of the holding part 5. The lock part 6 has a rotation axis A extending in the front-rear direction. The shaft pin 61 functions as the rotation axis A. The rotation axis A is located in the coupling part 53 between the first holding part 51 and the second holding part 52 in the up-down direction. The lock part 6 is rotatably displaced about the rotation axis A between a lock position indicated by a solid line in FIG. 3 and an unlock position indicated by a two-dot chain line in FIG. 3.

In the present embodiment, the lock position is a position where the lock part 6 contacts the outer circumferential surface of the front right pillar 11 from the rear side with respect to the front right pillar 11 at a position between the first holding part 51 and the second holding part 52. The unlock position is a position to release a contact of the lock part 6 with the outer circumferential surface of the front right pillar 11. When the lock part 6 is at the lock position, a longitudinal direction of the lock part 6 coincides with the left-right direction; and at the unlock position, the longitudinal direction of the lock part 6 coincides with the up-down direction.

When the lock part 6 is at the lock position, the lock part 6, the first holding part 51, and the second holding part 52 hold the front right pillar 11 and the coupling rod 30, to thereby lock the position of the holding part 5 with respect to the front right pillar 11 and the coupling rod 30. When the position of the holding part 5 is locked with respect to the front right pillar 11 and the coupling rod 30 in this manner, the holding part 5 is immovably fixed to the front right pillar 11 and the coupling rod 30 in the present embodiment. When the position of the holding part is locked with respect to the front right pillar 11 and the coupling rod 30, the holding part may loosely hold the front right pillar 11 and the coupling rod 30.

<Optional Accessory-Holding Part>

The optional accessory-holding part 7 holds the cup holder 3, which is an optional accessory and described later. The optional accessory-holding part 7 in the present embodiment is formed in a plate-shape and extends from the right end of the first wall part 511 of the first holding part 51 above the third wall part 513 of the first holding part 51. The optional accessory-holding part 7 extends in a direction away from the second wall part 512 of the first holding part 51.

<Cup Holder>

The cup holder 3 is fixed to the holding part 5 via the optional accessory-holding part 7. The cup holder 3 is formed like a bottomed cylinder and includes a bottom surface 31, a side wall 32 formed in a substantially cylindrical shape, and an opening 33. The cup holder 3 includes a protruding part 34, which is a part of the side wall 32 outwardly protruding. The protruding part 34 extends along a direction from the bottom surface 31 toward the opening 33. The cup holder 3 is fixed to the optional accessory-holding part 7 with a bolt 35 in a state where the protruding part 34 contacts a front surface of the optional accessory-holding part 7. The cup holder 3 holds a beverage container such as a cup and a plastic bottle.

The cup holder 3 includes a first through hole 321 in the side wall 32. The first through hole 321 is provided in the side wall 32 at a position facing the protruding part 34, and extends along the direction from the bottom surface 31 toward the opening 33. The first through hole 321 may be a hole continuous from the side wall 32 to the bottom surface 31 so as to include a part of the bottom surface 31. Furthermore, the cup holder 3 includes a second through hole 311 in the bottom surface 31. The second through hole 311 extends along a direction from the protruding part 34 toward the first through hole 321.

As described above, the cup holder 3 is fixed to the optional accessory-holding part 7 extending in the direction away from the second wall part 512 of the first holding part 51. Thus, the cup holder 3 is arranged diagonally frontward on the right side with respect to the front right pillar 11 in a state where the optional accessory-attaching member 4 is attached to the chair 2. Accordingly, as illustrated in FIGS. 1 and 2, even when the two chairs 2 are coupled to each other, the cup holder 3 does not easily interrupt mutual coupling of the two chairs 2 and does not affect sitting on the two chairs 2.

2. Attachment Procedure of Optional Accessory-Attaching Member to Chair

Figure 6:
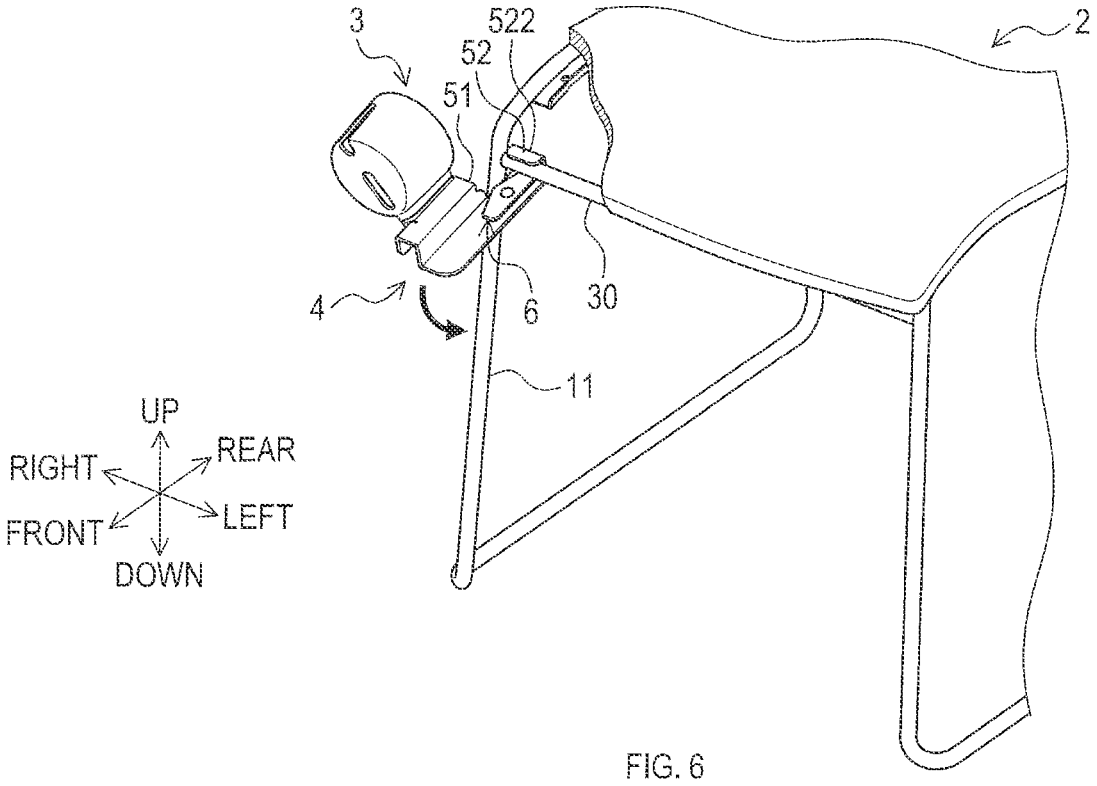
FIG. 6 is a view illustrating a state where a second holding part is attached to a coupling rod.
Figure 7:
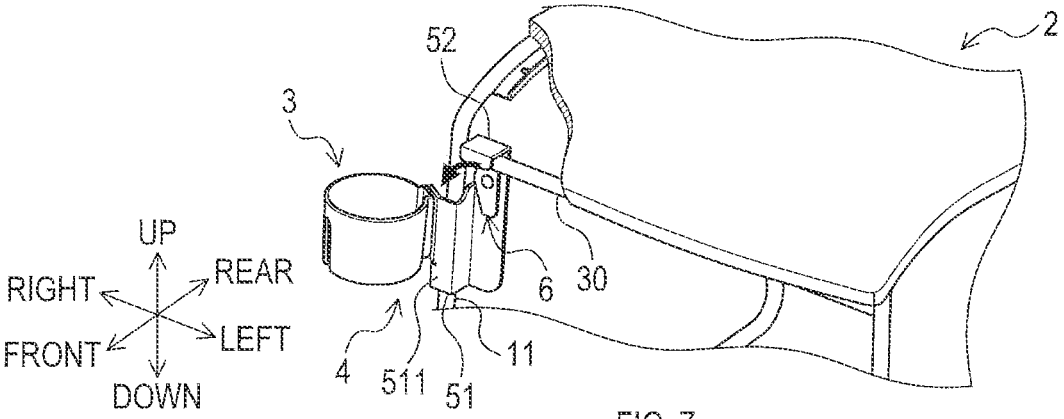
FIG. 7 is a view illustrating a state where, after the second holding part is attached to the coupling rod, the optional accessory-attaching member is rotated and then a first holding part is attached to a right leg.
Figure 8:
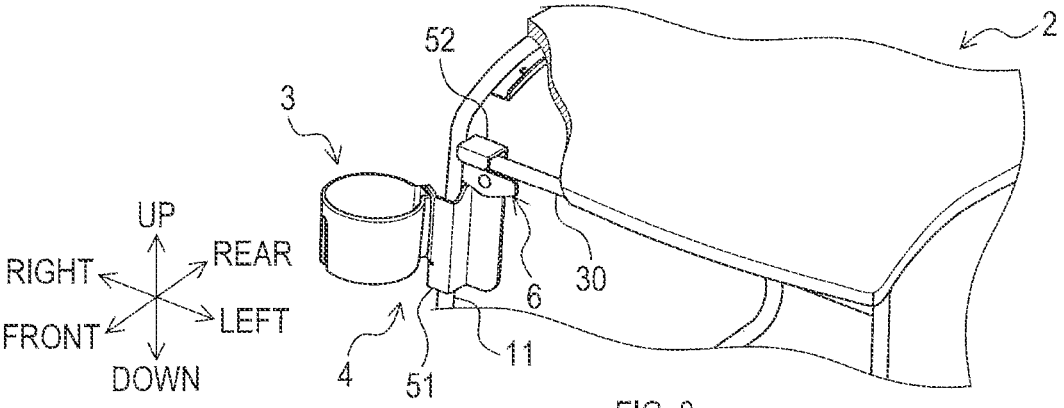
FIG. 8 is a view illustrating a state where the optional accessory-attaching member is attached to the chair with a lock part being displaced to a lock position and positions of the holding parts being locked with respect to a front right pillar and the coupling rod.

Next, reference is made to FIGS. 6 through 8 to describe an attachment procedure of the optional accessory-attaching member 4 to the chair 2.

First, as illustrated in FIG. 6, the second holding part 52 is arranged rearward of the coupling rod 30 to thereby make the coupling rod 30 run through the opening thereof so as to bring the second wall part 522 of the second holding part 52 into contact with the coupling rod 30. As a result, the second holding part 52 is attached to the coupling rod 30. At this time, the lock part 6 is located at the unlock position, and the first holding part 51 is arranged substantially in front of the front right pillar 11.

The optional accessory-attaching member 4 is rotatable about the coupling rod 30 as indicated by an arrow in FIG. 6 in a state where the second holding part 52 is attached to the coupling rod 30 as described above.

Subsequently, as illustrated in FIG. 7, the optional accessory-attaching member 4 is rotated downward about the coupling rod 30 to thereby make the front right pillar 11 run through the opening of the first holding part 51 so as to bring the first wall part 511 of the first holding part 51 into contact with the front right pillar 11. As a result, the first holding part 51 is attached to the front right pillar 11.

Finally, as illustrated in FIG. 8, the lock part 6 is displaced from the unlock position to the lock position so as to contact the front right pillar 11 from the rear side. At this time, the first wall part 511 of the first holding part 51 contacts the front right pillar 11 from the front side; and the first wall part 521 of the second holding part 52 contacts the coupling rod 30 from the front side. Specifically, on an opposite side to a side where the lock part 6 contacts the front right pillar 11 and the coupling rod 30, the first wall part 511 of the first holding part 51 contacts the front right pillar 11; and the first wall part 521 of the second holding part 52 contacts the coupling rod 30. Consequently, the first holding part 51, the second holding part 52, and the lock part 6 hold the front right pillar 11 and the coupling rod 30, to thereby restrict a movement of the holding part 5 with respect to the front right pillar 11 and the coupling rod 30 in the front-rear direction, the up-down direction, and the left-right direction. In the present embodiment, the movement of the holding part 5 in the up-down direction is also restricted by the second wall part 522 of the second holding part 52 contacting the coupling rod 30 from the upper side. Accordingly, in a state where the position of the holding part 5 is locked with respect to the front right pillar 11 and the coupling rod 30, attachment of the optional accessory-attaching member 4 to the chair 2 completes and the cup holder 3 is fixed to the chair 2.

In the case of removing the optional accessory-attaching member 4 from the chair 2, the optional accessory-attaching member 4 can be manipulated in a reverse manner to the procedure described above. Specifically, the lock part 6 is displaced from the lock position to the unlock position so as to release the position of the holding part 5 from being locked with respect to the front right pillar 11 and the coupling rod 30. Then, the optional accessory-attaching member 4 is rotated upward about the coupling rod 30 so as to remove the first holding part 51 from the front right pillar 11. Finally, the second holding part 52 is moved rearward so as to remove the second holding part 52 from the coupling rod 30. Accordingly, removal of the optional accessory-attaching member 4 from the chair 2 completes.

3. Effects

The embodiment described above can bring effects to be described below.

(3a) In the present embodiment, the first holding part 51 is attached to the front right pillar 11; and the second holding part 52 is attached to the coupling rod 30, and thereafter the lock part 6 is displaced from the unlock position to the lock position. At this time, the lock part 6 contacts the front right pillar 11 from the rear side, and the first wall part 511 of the first holding part 51 contacts the front right pillar 11 from the front side; and the first wall part 521 of the second holding part 52 contacts the coupling rod 30 from the front side. Consequently, the first holding part 51, the second holding part 52, and the lock part 6 hold the front right pillar 11 and the coupling rod 30, to thereby restrict the movement of the holding part 5 with respect to the front right pillar 11 and the coupling rod 30 in the front-rear direction, the up-down direction, and the left-right direction. Therefore, the holding part 5 can be attached to the chair 2 in a state where the position of the holding part 5 is locked with respect to the front right pillar 11 and the coupling rod 30. Moreover, when the lock part 6 is displaced from the lock position to the unlock position, the contact of the lock part 6 with the outer circumferential surface of the front right pillar 11 is released, which consequently releases the front right pillar 11 and the coupling rod 30 from being held by the lock part 6, the first holding part 51, and the second holding part 52. This makes it possible to remove the holding part 5 from the front right pillar 11 and the coupling rod 30. Accordingly, the optional accessory-attaching member 4 can be attached to and detached from the front right pillar 11 and the coupling rod 30 with a simple configuration of displacing a position of the lock part 6.

(3b) In the present embodiment, when the second holding part 52 holds the coupling rod 30, the second wall part 522 of the second holding part 52 contacts the coupling rod 30 from the upper side, whereby the second holding part 52 is hooked on the coupling rod 30. Therefore, a downward positional displacement of the holding part 5 can be easily suppressed.

(3c) In the present embodiment, the position of the holding part 5 can be locked or released from being locked with respect to the front right pillar 11 and the coupling rod 30 with a simple method of rotatably displacing, about the rotation axis A, the lock part 6 fixed to the coupling part 53.

(3d) The first holding part 51 in the present embodiment is shaped to allow the front right pillar 11 to run through the opening thereof, and to surround the outer circumferential surface of the front right pillar 11 at three positions with the first wall part 511, the second wall part 512, and the third wall part 513. Moreover, the second holding part 52 is shaped to allow the coupling rod 30 to run through the opening thereof, and to surround the outer circumferential surface of the coupling rod 30 at three positions with the first wall part 521, the second wall part 522, and the third wall part 523. Thus, the first holding part 51 and the second holding part 52 can be easily attached to and detached from the front right pillar 11 and the coupling rod 30, and the front right pillar 11 and the coupling rod 30 can be stably held by the holding part 5.

In the present embodiment, the front right pillar 11 and the coupling rod 30 correspond to one example of the pillar member; the front right pillar 11 corresponds to one example of the vertical pillar; and the coupling rod 30 corresponds to one example of the horizontal stretcher. Moreover, the front side with respect to the front right pillar 11 and the coupling rod 30 corresponds to one example of the first side; and the rear side with respect to the front right pillar 11 and the coupling rod 30 corresponds to the second side.

4. Other Embodiments

Although the embodiment of the present disclosure has been described hereinabove, the present disclosure is not limited to the above-described embodiment and can be implemented in various forms.

(4a) The above-described embodiment shows an example configuration in which the lock part 6 contacts the outer circumferential surface of the front right pillar 11 when at the lock position. However, a configuration of the optional accessory-attaching member is not limited hereto.

Figure 9:
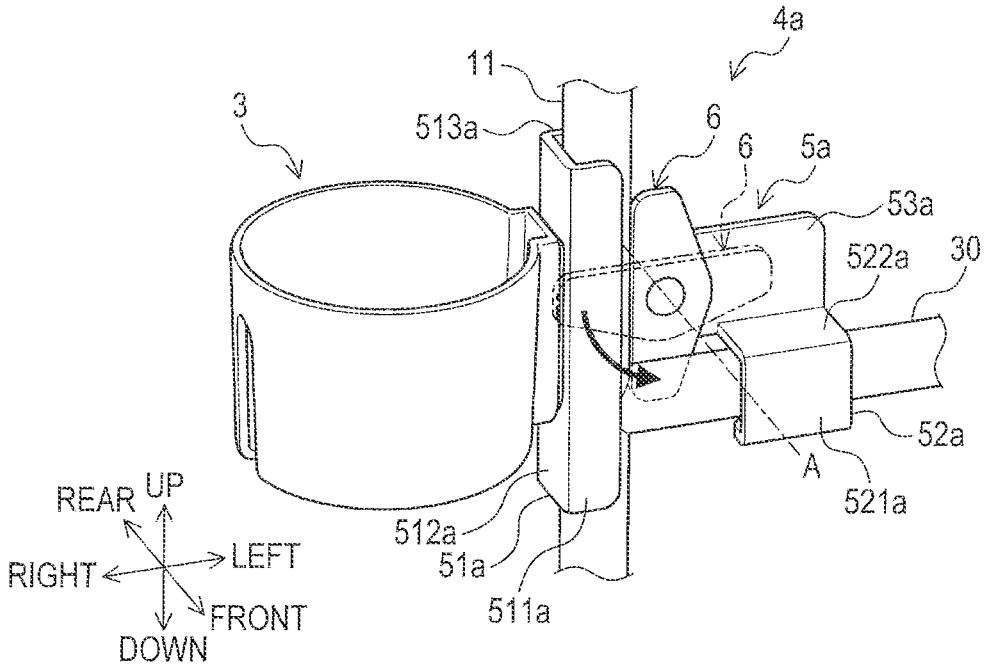
FIG. 9 is a view illustrating an optional accessory-attaching member according to another embodiment in which a lock part contacts a coupling rod when at a lock position.

For example, as in an optional accessory-attaching member **4*a* illustrated in FIG. 9, the lock part 6 may be configured to contact the outer circumferential surface of the coupling rod 30 when at the lock position. The optional accessory-attaching member 4*a* comprises a holding part 5*a*, the lock part 6, and the cup holder 3. The holding part 5*a* includes a first holding part 51*a*, a second holding part 52*a*, and a coupling part 53*a***.

The first holding part **51*a* faces the outer circumferential surface of the front right pillar 11 from the front, right, and rear sides, and holds the front right pillar 11. The first holding part 51*a* is formed in a plate-shape extending in the up-down direction, and has a substantially U-shaped configuration in a cross section orthogonal to the up-down direction. In other words, the first holding part 51*a* has a shape covering a part of the outer circumferential surface of the front right pillar 11 and opening leftward so as to allow the front right pillar 11 to run therethrough. Specifically, the first holding part 51*a* includes a first wall part 511*a*, a second wall part 512*a*, and a third wall part 513*a***.

The first wall part **511*a* faces the outer circumferential surface of the front right pillar 11 from the front side. The second wall part 512*a* extends substantially perpendicularly from a right end of the first wall part 511*a* toward the rear side, and faces the outer circumferential surface of the front right pillar 11 from the right side. The third wall part 513*a* extends substantially perpendicularly from a rear end of the second wall part 512*a* toward the left side, and faces the outer circumferential surface of the front right pillar 11** from the rear side.

In the first holding part **51*a*, an interval between an inner surface of the first wall part 511*a* and an inner surface of the third wall part 513*a* facing in the front-rear direction is larger than the summed length of the outer diameter of the front right pillar 11 and the thickness of the lock part 6. In other words, the first holding part 51***a* is formed such that the front right pillar 11 is loosely inserted therein.

The second holding part 52*a* faces the outer circumferential surface of the coupling rod 30 from the front and upper sides and holds the coupling rod 30 at a position different from and spaced apart from the first holding part 51*a*. The second holding part 52*a* is located leftward of the first holding part 51*a*. The second holding part 52*a* is formed in a plate-shape extending in the left-right direction, and has a substantially L-shaped configuration in a cross section orthogonal to the left-right direction. In other words, the second holding part 52*a* has a shape covering a part of the outer circumferential surface of the coupling rod 30 and opening downward and rearward so as to allow the coupling rod 30 to run therethrough. In other words, the second holding part 52*a* is hooked on the coupling rod 30. Specifically, the second holding part 52*a* includes a first wall part 521*a* and a second wall part 522*a*.

The first wall part 521*a* faces the outer circumferential surface of the coupling rod 30 from the front side. A little portion of a lower end of the first wall part 521*a* may be bent rearward. The second wall part 522*a* extends substantially perpendicularly from an upper end of the first wall part 521*a* to the rear side, and faces the outer circumferential surface of the coupling rod 30 from the upper side.

The coupling part 53*a* is a part coupling a left end of the third wall part 513*a* of the first holding part 51*a* to a rear end of the second wall part 522*a* of the second holding part 52*a*. The coupling part 53*a* is arranged substantially perpendicularly with respect to the second wall part 522*a* of the second holding part 52*a*, and is formed in a plate-shape extending in the left-right direction on the same plane as the third wall part 513*a* of the first holding part 51*a*. The coupling part 53*a* extends leftward from a center part of the first holding part 51 in the up-down direction.

An interval between an inner surface of the first wall part 521*a* of the second holding part 52*a* and a front surface of the coupling part 53*a* is substantially the same length as the summed length of the outer diameter of the coupling rod 30 and the thickness of the lock part 6. An interval between an inner surface of the first wall part of the second holding part and the front surface of the coupling part may be larger than the summed length of the outer diameter of the coupling rod 30 and the thickness of the lock part.

The lock part 6 is fixed so as to overlap with the front surface of the coupling part 53*a*, and rotatably displaced about the rotation axis A between a lock position indicated by a solid line in FIG. 9 and an unlock position indicated by a two-dot chain line in FIG. 9. When the lock part 6 is at the lock position, the longitudinal direction of the lock part 6 coincides with the up-down direction; and at the unlock position, the longitudinal direction of the lock part 6 coincides with the left-right direction.

When the lock part 6 is at the lock position, the lock part 6, the first holding part 51*a*, and the second holding part 52*a* hold the front right pillar 11 and the coupling rod 30, to thereby lock the position of the holding part 5*a* with respect to the front right pillar 11 and the coupling rod 30. When the position of the holding part 5*a* is locked with respect to the front right pillar 11 and the coupling rod 30 in this manner, the holding part 5*a* is immovably fixed to the front right pillar 11 and the coupling rod 30 in an example illustrated in FIG. 9. When the position of the holding part is locked with respect to the front right pillar 11 and the coupling rod 30, the holding part may loosely hold the front right pillar 11 and the coupling rod 30.

In the example illustrated in FIG. 9, the cup holder 3 is fixed to the second wall part 512*a* of the first holding part 51*a*. The cup holder 3 may be held by the first holding part 51*a* via the optional accessory-holding part.

In a configuration as in the optional accessory-attaching member 4*a*, the optional accessory-attaching member 4*a* can be attached to and detached from the front right pillar 11 and the coupling rod 30 with a simple configuration of displacing the position of the lock part 6. Moreover, in the configuration as in the optional accessory-attaching member 4*a*, a position to fix the cup holder 3 can be easily set high as compared to the optional accessory-attaching member 4 in the above-described embodiment. By changing positions in the up-down direction of the first holding part 51*a*, which is continuous to the coupling part, positions of the cup holder can be changed in the up-down direction.

(4b) The above-described embodiments show example configurations in which the holding part 5 can hold the front right pillar 11 and the coupling rod 30. However, the configuration of the optional accessory-attaching member is not limited hereto.

Figure 10:
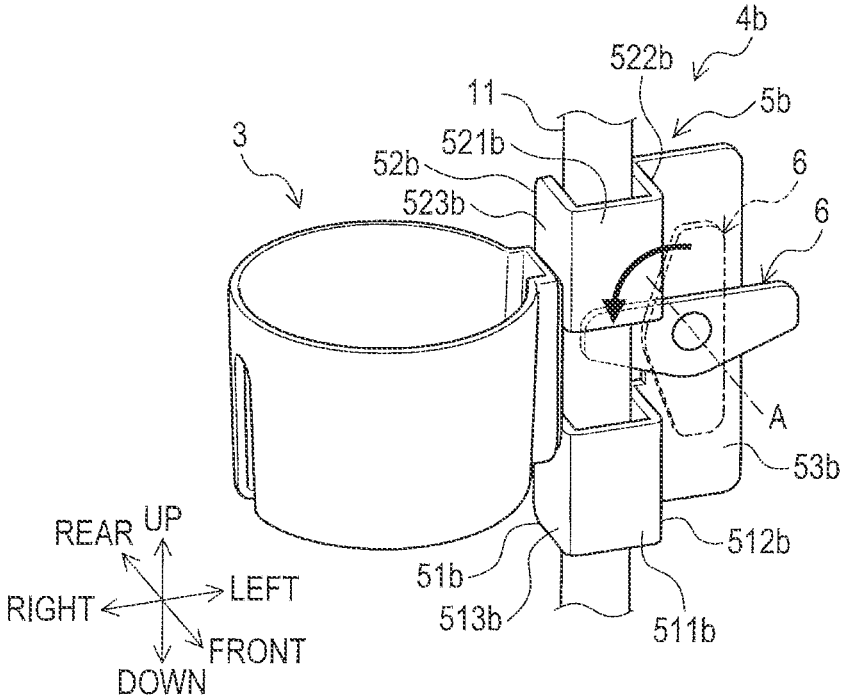
FIG. 10 is a view illustrating an optional accessory-attaching member according to another embodiment in which a holding part holds only the front right pillar of the chair.

For example, as in an optional accessory-attaching member 4*b* illustrated in FIG. 10, a holding part 5*b* may be configured to be able to hold only the front right pillar 11. The optional accessory-attaching member 4*b* comprises the holding part 5*b*, the lock part 6, and the cup holder 3. The holding part 5*b* includes a first holding part 51*b*, a second holding part 52*b*, and a coupling part 53*b*.

The first holding part 51*b* faces the outer circumferential surface of the front right pillar 11 from the front, right, and left sides, and holds the front right pillar 11. The first holding part 51*b* is formed in a plate-shape extending in the up-down direction, and has a substantially U-shaped configuration in a cross section orthogonal to the up-down direction. In other words, the first holding part 51*b* has a shape covering a part of the outer circumferential surface of the front right pillar 11 and opening rearward so as to allow the front right pillar 11 to run therethrough. Specifically, the first holding part 51*b* includes a first wall part 511*b*, a second wall part 512*b*, and a third wall part 513*b*.

The first wall part 511*b* faces the outer circumferential surface of the front right pillar 11 from the front side. The second wall part 512*b* extends substantially perpendicularly from a left end of the first wall part 511*b* to the rear side, and faces the outer circumferential surface of the front right pillar 11 from the left side. The third wall part 513*b* extends substantially perpendicularly from a right end of the first wall part 511*b* to the rear side, and faces the outer circumferential surface of the front right pillar 11 from the right side.

In the first holding part 51*b*, an interval between an inner surface of the second wall part 512*b* and an inner surface of the third wall part 513*b* facing in the left-right direction is substantially the same length as, or larger than the outer diameter of the front right pillar 11. In other words, the first holding part 51*b* is formed such that the front right pillar 11 is closely fitted to an inside of the first holding part 51*b*, or loosely inserted into the front right pillar 11.

As in the first holding part 51*b*, the second holding part 52*b* faces the outer circumferential surface of the front right pillar 11 from the front, right, and left sides, and holds the front right pillar 11 at a position different from and spaced apart from the first holding part 51*b*. The second holding part 52*b* is located above the first holding part 51*b*. As in the first holding part 51*b*, the second holding part 52*b* has a substantially U-shaped configuration in a cross section orthogonal to the up-down direction. Specifically, the second holding part 52*b* includes a first wall part 521*b* facing the outer circumferential surface of the front right pillar 11 from the front side; a second wall part 522*b* facing the outer circumferential surface of the front right pillar 11 from the left side; and a third wall part 523*b* facing the outer circumferential surface of the front right pillar 11 from the right side.

The coupling part 53*b* couples a rear end of the second wall part 512*b* of the first holding part 51*b* to a rear end of the second wall part 522*b* of the second holding part 52*b*, and is a plate-shaped part arranged substantially perpendicularly with respect to the second wall part 512*b* and the second wall part 522*b* and extending in the up-down direction.

An interval between respective inner surfaces of the first wall part 511*b* of the first holding part 51*b* and the first wall part 521*b* of the second holding part 52*b*, and a front surface of the coupling part 53*b* is substantially the same length as the summed length of the outer diameter of the front right pillar 11 and the thickness of the lock part 6.

The lock part 6 is fixed so as to overlap with the front surface of the coupling part 53*b*, and is rotatably displaced about the rotation axis A between a lock position indicated by a solid line in FIG. 10 and an unlock position indicated by a two-dot chain line in FIG. 10. When the lock part 6 is at the lock position, the longitudinal direction of the lock part 6 coincides with the left-right direction; and at the unlock position, the longitudinal direction of the lock part 6 coincides with the up-down direction.

When the lock part 6 is at the lock position, the lock part 6, the first holding part 51*b*, and the second holding part 52*b* hold the front right pillar 11, to thereby lock a position of the holding part 5*b* with respect to the front right pillar 11. When the position of the holding part 5*b* is locked with respect to the front right pillar 11 in this manner, the holding part 5*b* is immovably fixed to the front right pillar 11 in an example illustrated in FIG. 10.

In the example illustrated in FIG. 10, the cup holder 3 is fixed to the third wall part 513*b* of the first holding part 51*b* and the third wall part 523*b* of the second holding part 52*b*. The cup holder 3 may be held by any one of the first holding part 51*b* or the second holding part 52*b* via the optional accessory-holding part. Furthermore, the cup holder 3 may be held by the holding part 5*b* via the optional accessory-holding part.

In a configuration as in the optional accessory-attaching member 4*b*, the holding part 5*b* can be attached to the front right pillar 11 with a simple configuration in a chair without the coupling rod 30.

(4c) The above-described embodiments show example configurations in which the holding part 5 can hold the front right pillar 11 and the coupling rod 30. However, the holding part may be able to hold, for example, the front left pillar 21 and the coupling rod 30, or only the front left pillar 21. When the holding part holds the front left pillar 21 and the coupling rod 30, the optional accessory-attaching member has a configuration in which the first holding part 51, the optional accessory-holding part 7, and the cup holder 3 are mirror-symmetrical to the coupling part 53 of the optional accessory-attaching member 4 in the present embodiment. When the holding part holds only the front left pillar 21, the optional accessory-attaching member has a configuration in which the first holding part 51*b*, the second holding part 52*b*, and the cup holder 3 are mirror-symmetrical to the coupling part 53*b* of the optional accessory-attaching member 4*b* in another embodiment.

(4d) In the above-described embodiments, the piece of furniture to which the optional accessory-attaching member 4 is used is the chair 2. However, the optional accessory-attaching member 4 may be attached to, for example, a piece of furniture such as a table including a pillar member to which the holding part 5 can be attached.

(4e) In the above-described embodiments, although the optional accessory of the optional accessory-attaching member 4 is the cup holder 3, the optional accessory is not limited hereto. For example, the optional accessory may be another light-weight optional accessory such as an accessory case.

(4f) In the above-described embodiments, although the lock part 6 is fixed to the coupling part 53 in a rotatable manner about the rotation axis A, a configuration of the lock part is not limited hereto. For example, the lock part may be configured to be displaceable between the lock position and the unlock position by sliding in the left-right direction or the up-down direction with respect to the coupling part. In this case, the lock part may be formed to be thinner at its ends on a contacting side with the front right pillar 11 or the coupling rod 30 and thicker at its ends on an opposite side of the contacting side.

(4g) In the above-described embodiments, the first holding part 51 is formed in the substantially U-shape covering the outer circumferential surface of the front right pillar 11 in three directions; and the second holding part 52 is formed in the substantially U-shape covering the outer circumferential surface of the coupling rod 30 in three directions. However, for example, the first holding part may be formed in a substantially L-shape covering the outer circumferential surface of the front right pillar 11 in two directions; and the second holding part may be formed in a substantially L-shape covering the outer circumferential surface of the coupling rod 30 in two directions.

(4h) A function performed by a single element in the aforementioned embodiments may be achieved by two or more elements, or a function performed by two or more elements may be achieved by a single element. Also, a part of a configuration in the aforementioned embodiments may be omitted. Moreover, at least a part of a configuration in the aforementioned embodiments may be added to or replaced with another configuration in the aforementioned embodiments.

5. Technical Ideas Disclosed in Present Disclosure

[Item 1]

An optional accessory-attaching member to be used in a piece of furniture including a pillar member, the optional accessory-attaching member comprising:

a holding part configured to hold the pillar member;

a lock part configured to be able to lock a position of the holding part with respect to the pillar member; and an optional accessory-holding part configured to hold an optional accessory;

the holding part including:

a first holding part including a part configured to face an outer circumferential surface of the pillar member from a first side with respect to the pillar member; and a second holding part including a part configured to face the outer circumferential surface of the pillar member from the first side at a position different from and spaced apart from the first holding part, the lock part being configured to be displaced between a lock position and an unlock position, the lock position bringing the lock part into contact with the outer circumferential surface of the pillar member from a second side substantially opposite to the first side with respect to the pillar member at a position between the first holding part and the second holding part, and the unlock position releasing a contact of the lock part with the outer circumferential surface of the pillar member, and when the lock part is at the lock position, the first holding part and the second holding part as well as the lock part holding the pillar member, to thereby lock the position of the holding part with respect to the pillar member.

[Item 2]

The optional accessory-attaching member according to Item 1, wherein the pillar member includes a vertical pillar extending in a substantially up-down direction and a horizontal stretcher extending from the vertical pillar in a direction intersecting the substantially up-down direction, wherein the holding part is configured to hold the vertical pillar and the horizontal stretcher, wherein the first holding part is configured to face an outer circumferential surface of the vertical pillar from the first side, wherein the second holding part includes a part configured to face an outer circumferential surface of the horizontal stretcher from the first side and from an upper side, and wherein, when the lock part is at the lock position, the lock part contacts the outer circumferential surface of the vertical pillar or the outer circumferential surface of the horizontal stretcher from the second side.

[Item 3]

The optional accessory-attaching member according to Item 1, wherein the pillar member includes a vertical pillar extending at least in a substantially up-down direction, wherein the holding part is configured to hold the vertical pillar, wherein the first holding part and the second holding part are configured to face an outer circumferential surface of the vertical pillar from the first side, and wherein, when the lock part is at the lock position, the lock part contacts the outer circumferential surface of the vertical pillar from the second side.

[Item 4]

The optional accessory-attaching member according to any one of Items 1 through 3, wherein the holding part includes a coupling part coupling the first holding part to the second holding part, and wherein the lock part is fixed to the coupling part, the lock part including a rotation axis extending from the first side toward the second side, and the lock part being configured to be rotatably displaced about the rotation axis between the lock position and the unlock position.

[Item 5]

The optional accessory-attaching member according to any one of Items 1 through 4, wherein each holding part of the first holding part and the second holding part includes:

a first wall part configured to face the outer circumferential surface of the pillar member from the first side; and two other wall parts coupled to the first wall part, the two other wall parts being configured to face the outer circumferential surface of the pillar member at respective two other positions different from a position of the first wall part.

What is claimed is:

1. An optional accessory-attaching member to be used in a piece of furniture including a pillar member, the optional accessory-attaching member comprising:

a holding part configured to hold the pillar member;

a lock part configured to be able to lock a position of the holding part with respect to the pillar member; and an optional accessory-holding part configured to hold an optional accessory;

the holding part including:

a first holding part including a part configured to face an outer circumferential surface of the pillar member from a first side with respect to the pillar member; and a second holding part including a part configured to face the outer circumferential surface of the pillar member from the first side at a position different from and spaced apart from the first holding part, the lock part being configured to be displaced between a lock position and an unlock position, the lock position bringing the lock part into contact with the outer circumferential surface of the pillar member from a second side substantially opposite to the first side with respect to the pillar member at a position between the first holding part and the second holding part, and the unlock position releasing a contact of the lock part with the outer circumferential surface of the pillar member, and when the lock part is at the lock position, the first holding part and the second holding part as well as the lock part holding the pillar member, to thereby lock the position of the holding part with respect to the pillar member.

2. The optional accessory-attaching member according to claim 1, wherein the pillar member includes a vertical pillar extending in a substantially up-down direction and a horizontal stretcher extending from the vertical pillar in a direction intersecting the substantially up-down direction, wherein the holding part is configured to hold the vertical pillar and the horizontal stretcher, wherein the first holding part is configured to face an outer circumferential surface of the vertical pillar from the first side, wherein the second holding part includes a part configured to face an outer circumferential surface of the horizontal stretcher from the first side and from an upper side, and wherein, when the lock part is at the lock position, the lock part contacts the outer circumferential surface of the vertical pillar from the second side.

3. The optional accessory-attaching member according to claim 1, wherein the pillar member includes a vertical pillar extending in a substantially up-down direction and a horizontal stretcher extending from the vertical pillar in a direction intersecting the substantially up-down direction, wherein the holding part is configured to hold the vertical pillar and the horizontal stretcher, wherein the first holding part is configured to face an outer circumferential surface of the vertical pillar from the first side, wherein the second holding part includes a part configured to face an outer circumferential surface of the horizontal stretcher from the first side and from an upper side, and wherein, when the lock part is at the lock position, the lock part contacts the outer circumferential surface of the horizontal stretcher from the second side.

4. The optional accessory-attaching member according to claim 1, wherein the pillar member includes a vertical pillar extending at least in a substantially up-down direction, wherein the holding part is configured to hold the vertical pillar, wherein the first holding part and the second holding part are configured to face an outer circumferential surface of the vertical pillar from the first side, and wherein, when the lock part is at the lock position, the lock part contacts the outer circumferential surface of the vertical pillar from the second side.

5. The optional accessory-attaching member according to claim 1, wherein the holding part includes a coupling part coupling the first holding part to the second holding part, and wherein the lock part is fixed to the coupling part, the lock part including a rotation axis extending from the first side toward the second side, and the lock part being configured to be rotatably displaced about the rotation axis between the lock position and the unlock position.

6. The optional accessory-attaching member according to claim 1, wherein each holding part of the first holding part and the second holding part includes:

a first wall part configured to face the outer circumferential surface of the pillar member from the first side; and two other wall parts coupled to the first wall part, the two other wall parts being configured to face the outer circumferential surface of the pillar member at respective two other positions different from a position of the first wall part.

* * * * *